United States Patent [19]

Suzuki et al.

[11] Patent Number: 4,692,065

[45] Date of Patent: Sep. 8, 1987

[54] OFFSHORE UNIT STRUCTURE

[75] Inventors: Yoshio Suzuki; Mitsuoki Yamamoto, both of Tokyo; Hisashi Hosomi, Saitama, all of Japan

[73] Assignee: Takenaka Komuten Co., Ltd., Osaka, Japan

[21] Appl. No.: 774,588

[22] PCT Filed: Apr. 26, 1985

[86] PCT No.: PCT/JP85/00240

§ 371 Date: Aug. 26, 1985

§ 102(e) Date: Aug. 26, 1985

[87] PCT Pub. No.: WO85/05138

PCT Pub. Date: Nov. 21, 1985

[30] Foreign Application Priority Data

Apr. 23, 1984 [JP] Japan ..... 59-87379

[51] Int. Cl.[4] ..... E02B 17/00; E02D 27/52

[52] U.S. Cl. ..... 405/211; 405/217; 405/224; 405/229

[58] Field of Search ..... 405/211, 217, 222, 224, 405/225, 226, 229, 266

[56] References Cited

U.S. PATENT DOCUMENTS

| | | | |
|---|---|---|---|
| 2,652,693 | 9/1953 | Goldman et al. . | |
| 2,938,353 | 5/1960 | Vorenkamp . | |
| 3,021,680 | 2/1962 | Hayward . | |
| 3,529,919 | 9/1970 | Tiraspolsky et al. . | |
| 3,896,628 | 7/1975 | Hansen . | |
| 3,906,734 | 9/1975 | Pogonowski et al. . | |
| 3,911,687 | 10/1975 | Mo . | |
| 4,036,161 | 7/1977 | Nixon . | |
| 4,040,263 | 8/1977 | Eide et al. . | |
| 4,063,424 | 12/1977 | Takagi et al. | 405/222 X |
| 4,397,586 | 8/1983 | Weiss | 405/217 |
| 4,420,275 | 12/1983 | Ruser | 405/217 |
| 4,425,055 | 1/1984 | Tiedemann . | |
| 4,470,725 | 9/1984 | Kure et al. | 405/217 X |

FOREIGN PATENT DOCUMENTS

| | | |
|---|---|---|
| 50-1303 | 1/1975 | Japan . |
| 51-43811 | 4/1975 | Japan . |
| 56-26725 | 3/1981 | Japan . |
| 56-28921 | 3/1981 | Japan . |
| 56-150222 | 11/1981 | Japan . |
| 57-66216 | 4/1982 | Japan . |
| 2058181 | 4/1981 | United Kingdom . |

*Primary Examiner*—David H. Corbin

*Attorney, Agent, or Firm*—Parkhurst & Oliff

[57] ABSTRACT

This invention relates to an offshore unit structure. When the sea bottom ground on which an offshore structure is to be built is weak, in order to prevent the structure from being deformed by gravitational load of the structure or by horizontal load applied thereto, a cement type solidifying agent is impregnated into and mixed with subsoil in such weak ground to construct a unit-volume reformed ground, and a unit structure body is built upon such reformed ground. The structure according to this invention can be advantageously used for prospecting or producing oil in the sea.

1 Claim, 10 Drawing Figures

OFFSHORE UNIT STRUCTURE

BACKGROUND OF THE INVENTION

The present invention relates to an offshore unit structure. When building up an offshore unit structure on a sea bottom soft ground, in order to prevent the structure from being deformed by gravitational load of the structure or by horizontal load applied thereto, a cement type solidifying agent is impregnated into and mixed with such soft ground to construct a unit-volume reformed ground, and the desired structure is built upon such reformed ground.

The present invention also can be applied to a unit structure used in prospecting for or production of oil in the sea.

For prospecting for or production of oil in the sea such as the Arctic Ocean, it is required to build a platform or artificial island at every spot well head.

In the Arctic Ocean, however, the structure built upon the sea bottom is subject to a heavy horizontal load by ice, and even a slight slide of the structure in the horizontal direction due to such ice load or an earthquake may cause serious damage to the pipes and other members which run deep into the sea bottom ground, so that the platform or artificial island must be constructed firm and steadfast. In the case of the conventional construction methods, it costs a great deal to build such a structure, and the built structure has a safety problem. Further, the conventional construction of the structure requires too much time, and therefore it is hardly possible to build the structure during the short summer in the Arctic.

SUMMARY OF THE INVENTION

The present invention is intended to solve these prior art problems and has as an object the provision of an offshore unit structure which is firm and stable and enables a low-cost, rapid construction thereof. In accordance with the present invention, a cement type solidifying agent is impregnated into and mixed with the soft ground of the sea bottom to construct a unit-volume reformed ground, and a unit structure body is built upon such reformed ground either directly or with the medium of rubble-mound.

DESCRIPTION OF THE PREFERRED EMBODIMENTS

The present invention is further described below by way of the embodiments thereof as illustrated in the accompanying drawings.

Figure 1:
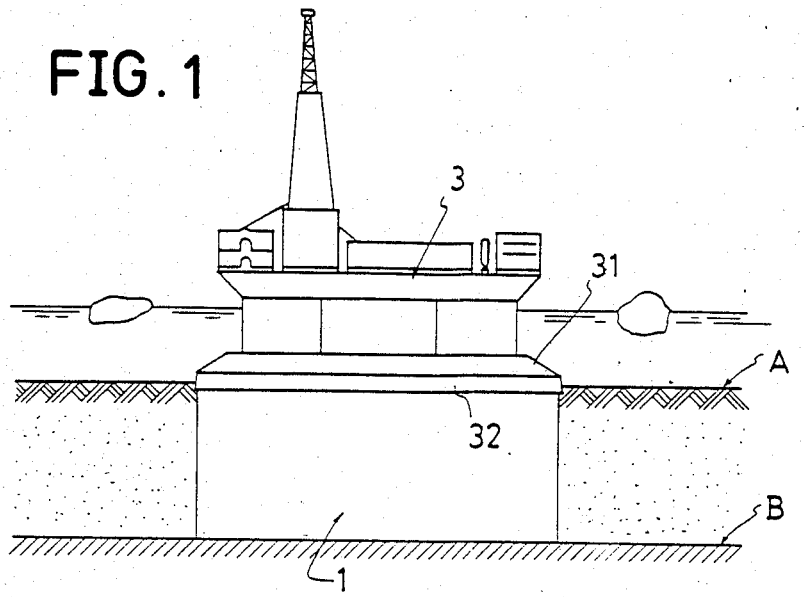
FIG. 1 is a side view of the first embodiment of the present invention.
Figure 2:
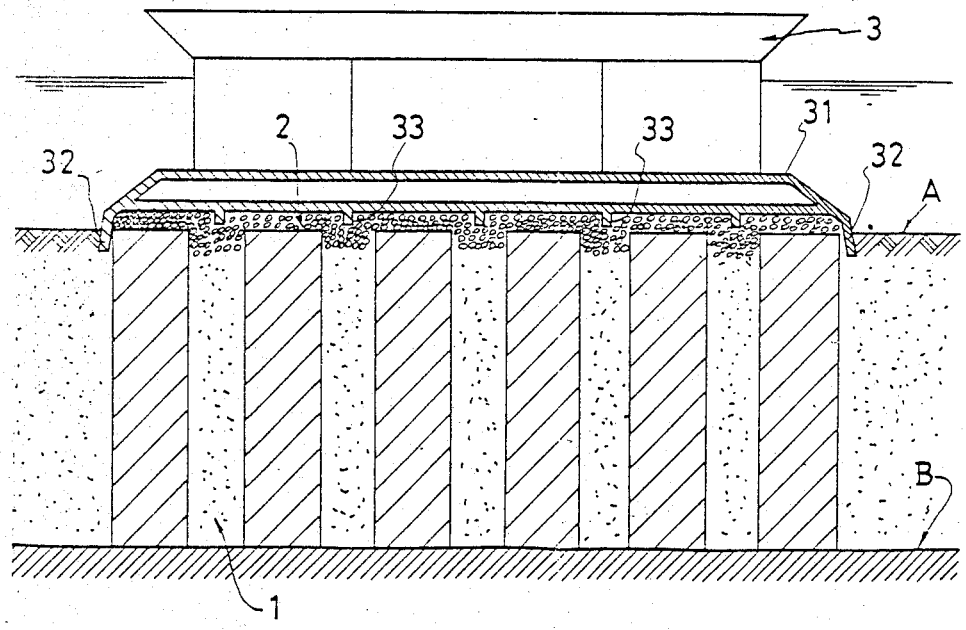
FIG. 2 is an enlarged sectional view of the principal parts of the first embodiment.

FIGS. 1 and 2 illustrate a first embodiment of the present invention. In these drawings, A denotes a sea bottom soft ground, and B denotes a support ground beneath said soft ground.

In accordance with this invention, an underground mixing and processing apparatus provided with excavating blades and agitating elements is run into the sea-bottom soft ground A from a work boat and a cement type solidifying agent is charged into the ground A through said apparatus. Thus, said solidifying agent is impregnated into and mixed with the subsoil in said soft ground A, thereby constructing a unit-volume reformed (solidified) ground 1 which reaches the support ground B. Then rubble-mound 2 is laid over said reformed ground 1 and a unit structure body such as a platform 3 is built up on said rubble-mound 2.

Figure 3:
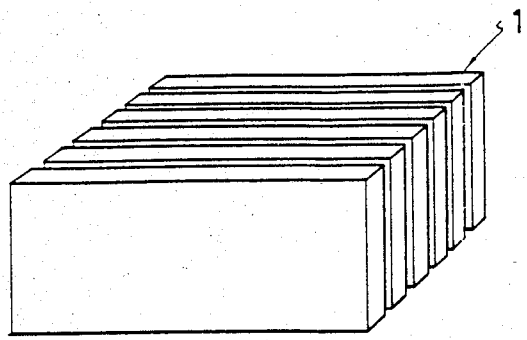
FIGS. 3 to 8 are perspective views showing the several forms of the reformed ground.
Figure 4:
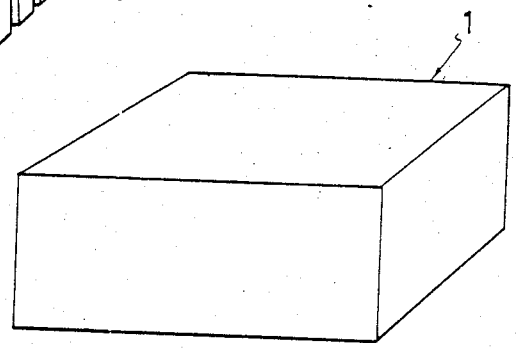
Figure 5:
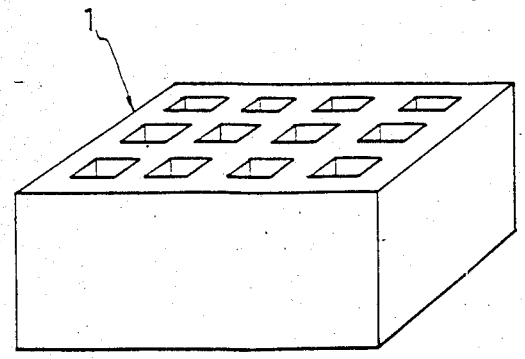
Figure 6:
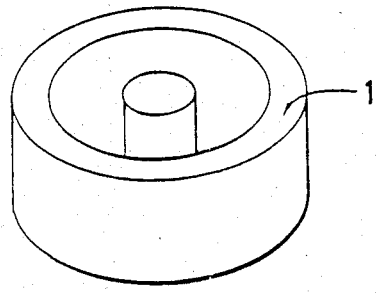
Figure 7:
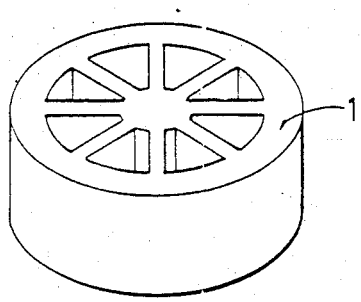
Figure 8:
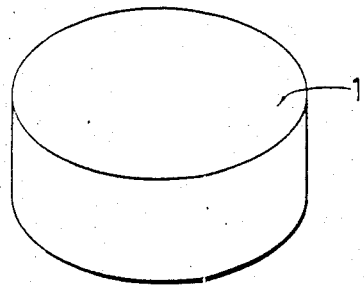

The reformed ground 1 may be profiled in diverse ways. For example, it may take a rectangular form as a whole, such as wall-like as shown in FIG. 3, block-type as shown in FIG. 4, and lattice-shaped as shown in FIG. 5, and also may take a columnar form as a whole, such as concentric double-column as shown in FIG. 6, wheel-like as shown in FIG. 7, and block-type as shown in FIG. 8.

The platform 3, made of steel or concrete, has a skirt 32 extending downward from the periphery of a platform base 31, said skirt 32 encircling the reformed ground 1. Also, a plurality of raised strips 33 are provided on the underside of said base 31 so that they are thrust into rubble-mound 2.

The profile of said platform base may be properly selected in accordance with the configuration of reformed ground 1. The raised strips 33 may be formed sharp-edged so that they may be easily thrust into the rubble-mound.

Being provided and constructed as described above, the structure of this invention can resist against gravitational force by virtue of the compressive stress of reformed ground 1, while the sliding force given thereto in the horizontal direction can be counteracted by the shearing stress of skirt 32 and raised strips 33, the shearing stress of rubble-mound 2, the shearing stress produced between rubble-mound 2 and reformed ground 1, the shearing stress of reformed ground 1, and the shearing stress at the bottom of reformed ground 1. Thus, the structure of this invention is firm and steadfast against horizontal ice load or earthquake.

When prospecting for oil has ended and the platform 3 is no longer needed, it can be hoisted up and moved away.

As a modification of the above-described embodiment, platform 3 may be directly built upon reformed ground 1, with no medium of rubble-mound 2, where the situations of the work area, the conditions in use and the other factors permit such direct building.

Figure 9:
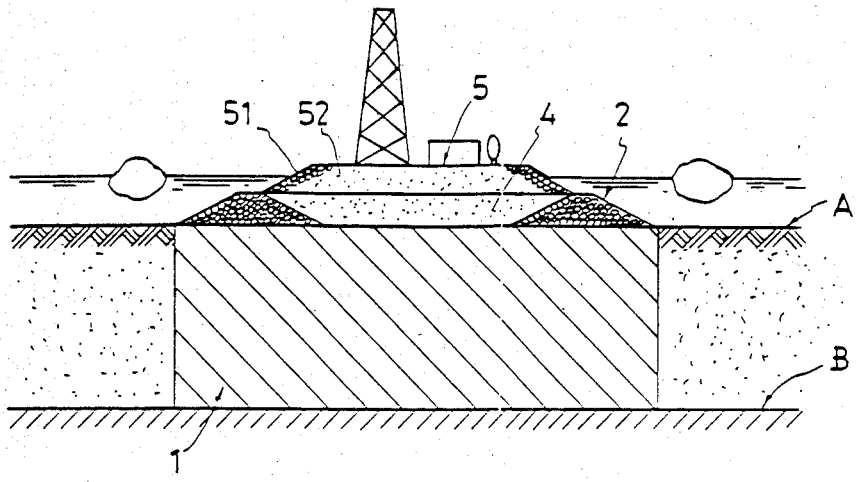
FIG. 9 is a sectional view of the second embodiment of the present invention.

FIG. 9 illustrates a second embodiment of the present invention. In this case, rubble-mound 2 is built on and along the periphery of reformed ground 1 which is constructed in the same way as the first embodiment described above, and then earth 4 is laid on the area surrounded by said rubble-mound 2, and on this base is built an artificial island 5, which is a unit structure body in the concept of this invention, said artificial island being formed by a circumferential stone wall 51 and an earth mound 52.

Figure 10:
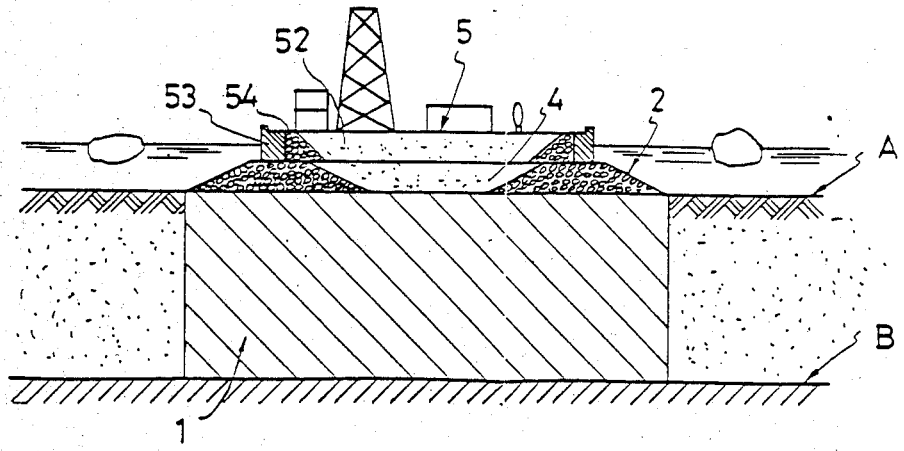
FIG. 10 is a sectional view of the third embodiment of the present invention.

FIG. 10 illustrates a third embodiment of this invention, in which the artificial island 5 of the above second embodiment is surrounded by a caisson 53. On the inside of said caisson 53 is built reinforcing rubble-mound 54, and earth mound 52 fills the inside of said reinforcing rubble-mound 54.

In both of the above second and third embodiments, gravitational force is countervailed by the compressive stress of reformed ground 1, while the sliding force in the horizontal direction can be cancelled by the shearing stress produced between artificial island 5 and rubble-mound 2 and earth 4, the shearing stress of rubble-mound 2 and earth 4, the shearing stress produced between rubble-mound 2 and earth 4 and reformed ground 1, the shearing stress of reformed ground 1, and the shearing stress at the bottom of reformed ground 1. Thus, the artificial island is firm and steadfast against horizontal ice load or earthquake. The present invention also can be applied to a submarine unit structure.

The present invention finds particularly useful application in trial drilling for or production of oil in the Arctic. The offshore unit structure according to the present invention, in its unit structure form, can resist firmly and stably against gravitational force by the reformed ground on which the structure is built. It can also counteract firmly and stably sliding force in the horizontal direction produced by horizontal ice load or earthquake, owing to the increased frictional resistance, especially that between the reformed ground and the unit structure body. Further, the structure according to this invention can be built easily and rapidly during the short summer season in the Arctic region. Moreover, waste is minimized since the structure of this invention is economical and easy to install and remove.

What is claimed is:

1. An offshore structure comprising:

an improved ground solidified by impregnating a cement type agent into a soft sea bottom ground and mixing them, the improved ground having at least one top open vertical hole;

a rubble mound laid on the improved ground;

a unit structure installed on the rubble mound;

a skirt extending downwardly from a lower periphery of the unit structure and encircling an upper part of the improved ground; and at least one raised strip which is provided at an underside of the unit structure and which is thrust into the rubble mound;

wherein a part of the rubble mound is pressed into an upper part of the vertical hole by the vertical load of the unit structure.

* * * * *